US009631634B2

(12) United States Patent
Daimer et al.

(10) Patent No.: US 9,631,634 B2
(45) Date of Patent: Apr. 25, 2017

(54) TURBOCHARGER WITH FRICTION-INCREASING COATING

(75) Inventors: Guido Daimer, Remseck (DE); Stefan Muenz, Ludwigshafen (DE)

(73) Assignee: Bosch Mahle Turbo Systems GmbH & Co. KG (DE)

( * ) Notice: Subject to any disclaimer, the term of this patent is extended or adjusted under 35 U.S.C. 154(b) by 1271 days.

(21) Appl. No.: 12/604,657

(22) Filed: Oct. 23, 2009

(65) Prior Publication Data

US 2010/0104457 A1 Apr. 29, 2010

(30) Foreign Application Priority Data

Oct. 25, 2008 (DE) ..... 10 2008 053 222

(51) Int. Cl.

| | |
|---|---|
| ***F04D 29/26*** | (2006.01) |
| ***F01D 5/02*** | (2006.01) |
| ***F04D 29/02*** | (2006.01) |
| ***F01D 5/04*** | (2006.01) |

(52) U.S. Cl.

CPC ..... *F04D 29/266* (2013.01); *F01D 5/025* (2013.01); *F01D 5/048* (2013.01); *F04D 29/023* (2013.01); *F05D 2220/40* (2013.01); *F05D 2230/23* (2013.01); *F05D 2230/90* (2013.01); *F05D 2260/37* (2013.01); *F05D 2300/502* (2013.01);

(Continued)

(58) Field of Classification Search

CPC ..... F01D 5/025; F01D 5/048; F04D 29/023; F04D 29/266; F05D 2260/37; F05D 2300/502; F05D 2230/90; F05D 2230/23; F05D 2300/506; F05D 2300/611; F05D 2220/40

USPC ..... 60/597; 428/323, 328; 415/200, 216.1; 416/204 R, 241 R; 417/407

See application file for complete search history.

(56) References Cited

U.S. PATENT DOCUMENTS 3,692,341 A * 9/1972 Brown ..... C09J 175/04 403/408.1
4,154,276 A * 5/1979 Wesner ..... F16B 2/005 411/337
4,519,747 A * 5/1985 Yamazaki et al. ..... 416/244 A (Continued)

FOREIGN PATENT DOCUMENTS

DE 0152972 A1 12/1981
DE 10117565 A1 7/2002

(Continued)

OTHER PUBLICATIONS

The Engineering ToolBox, www.EngineeringToolBox.com, Thermal Conductivity of some common Materials and Gases, printed Aug. 27, 2016.*

(Continued)

*Primary Examiner* — Mary A Davis
(74) *Attorney, Agent, or Firm* — Fishman Stewart PLLC

(57) ABSTRACT

The turbocharger according to the invention has a rotor with a compressor wheel as well as a turbine wheel that is connected in a rotationally-fixed manner to the compressor wheel by means of a common shaft. The compressor wheel and the shaft are form-fittingly tensioned with one another, wherein respectively at least one or two torque-transmitting contact surfaces, which lie one atop the other, between components force-fittingly tensioned with one another, is provided with a friction-increasing coating.

13 Claims, 1 Drawing Sheet

(52) U.S. Cl.
CPC .. *F05D 2300/506* (2013.01); *F05D 2300/611* (2013.01)

(56) References Cited

U.S. PATENT DOCUMENTS

| | | | | |
|---|---|---|---|---|
| 4,525,098 | A * | 6/1985 | Krude | F16D 1/027 285/256 |
| 4,538,969 | A * | 9/1985 | Ammann et al. | 417/407 |
| 4,564,555 | A * | 1/1986 | Hornberger | 428/312.8 |
| 4,636,434 | A * | 1/1987 | Okamura et al. | 428/328 |
| 4,699,839 | A * | 10/1987 | Hornberger | 428/312.8 |
| 5,783,315 | A * | 7/1998 | Schaeffer et al. | 428/633 |
| 6,347,905 | B1 * | 2/2002 | Lukschandel | 403/404 |
| 6,884,461 | B2 * | 4/2005 | Ackerman et al. | 427/229 |
| 6,899,522 | B2 * | 5/2005 | Baur et al. | 415/216.1 |
| 7,010,917 | B2 * | 3/2006 | Billington | 60/605.1 |
| 7,224,096 | B2 * | 5/2007 | Meacham et al. | 310/216.065 |
| 7,287,960 | B2 * | 10/2007 | Decker | 416/213 R |
| 7,331,757 | B2 * | 2/2008 | Janssen et al. | 415/200 |
| 7,744,351 | B2 * | 6/2010 | Jabado et al. | 416/241 R |
| 2003/0087097 | A1 * | 5/2003 | Lukschandel et al. | 428/408 |
| 2003/0148140 | A1 * | 8/2003 | Oguma et al. | 428/629 |
| 2004/0005452 | A1 * | 1/2004 | Dorfman et al. | 428/323 |
| 2004/0202556 | A1 * | 10/2004 | Svihla et al. | 417/407 |
| 2005/0036893 | A1 * | 2/2005 | Decker | 416/244 A |
| 2005/0064228 | A1 * | 3/2005 | Darolia et al. | 428/680 |
| 2006/0134455 | A1 * | 6/2006 | Belhadjhamida et al. | 428/668 |
| 2008/0008595 | A1 * | 1/2008 | McKenzie | 416/223 B |
| 2010/0054944 | A1 * | 3/2010 | Fledersbacher et al. | 416/204 A |
| 2010/0304181 | A1 * | 12/2010 | Anand et al. | 428/627 |
| 2010/0319344 | A1 * | 12/2010 | Mckenzie | 60/605.1 |
| 2011/0014059 | A1 * | 1/2011 | Giovannetti et al. | 416/241 R |
| 2011/0064581 | A1 * | 3/2011 | Bassler et al. | 416/213 R |

FOREIGN PATENT DOCUMENTS

| | | | |
|---|---|---|---|
| DE | 10359328 | A1 | 7/2005 |
| DE | 102007014861 | A1 | 10/2008 |
| EP | 0961038 | A1 | 12/1999 |
| WO | WO-2007/137445 | | 12/2007 |

OTHER PUBLICATIONS

Dictionary.com definitions of granule and particle, printed on Aug. 27, 2016.*
English abstract for DE-10359328.
English abstract for EP-0961038.

* cited by examiner

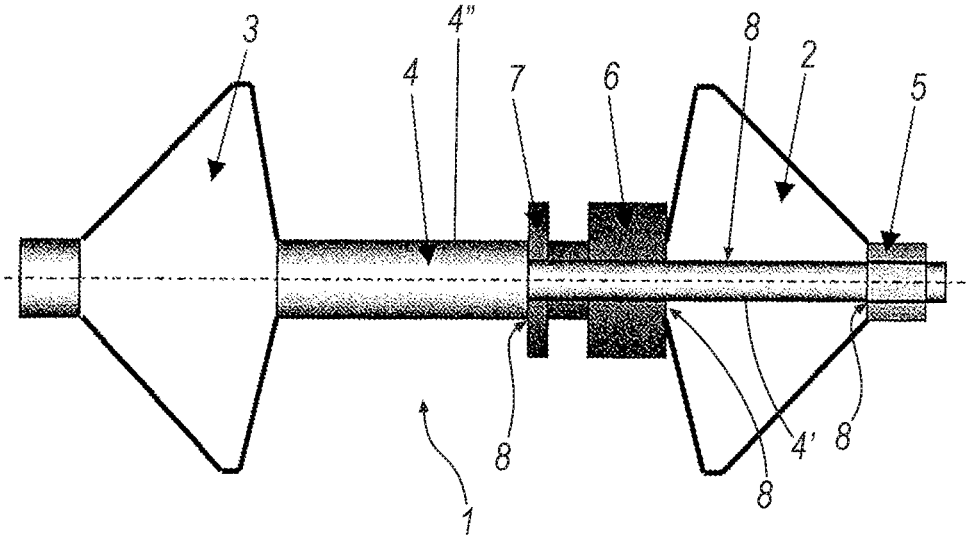
3
4"
4
7
6
8
2
5
8
4'
8
8
1

TURBOCHARGER WITH FRICTION-INCREASING COATING

CROSS-REFERENCES TO RELATED APPLICATION

This application claims priority to German patent application DE 10 2008 053 222.3 filed on Oct. 25, 2008, which is hereby incorporated by reference in its entirety.

TECHNICAL FIELD

The invention relates to a turbocharger having a rotor with turbine and rotor wheels as well as a rotor shaft connecting the turbine and the compressor well in a rotationally fixed manner, said rotor shaft having a force-fit connection of compressor wheel and rotor wheel.

BACKGROUND

Such a turbocharger is represented in document U.S. Pat. No. 7,010,917 B2.

According to this document, it is provided for a force-fit connection between shaft and compressor wheel to axially tension the compressor wheel between a nut, which is screwed on a screw thread on the free end of the shaft, and an annular step on the shaft. In order to increase the transferable torque between shaft and compressor wheel, the contact surfaces, which are resting one atop the other, of the nut and compressor wheel are configured to increase friction. In order to enable the contact surfaces, which are configured as friction increasing, to be effective, high axial tension forces must be present. Therefore, plastic deformations must be anticipated in the connection region between shaft and compressor wheel, said plastic deformations limiting the transferable torque, because the turbine wheel that is impinged upon with hot exhaust gas causes a high heat flow over the shaft to the compressor wheel and therefore high temperatures can arise in the connection area between shaft and compressor wheel.

In document EP 0 961 038 A1, a connecting element for a friction-increasing connection of work pieces to be fused is described. This connecting element consists of a thin, resiliently elastic film that supports particles of a defined size on its surface, wherein these particles consist of a material having a pressure and shear resistance that surpasses that of the work pieces to be fused. In the force-fit connection of the work pieces to be fused, these particles are pressed into the work piece surfaces, which are positioned opposite one another, and thereby produce a form-fitting connection between the work pieces.

It is disadvantageous here that in the assembly of the force-fit connection, a comparably large number of parts must be handled and supplied. Moreover, an incorrect assembly with a connecting element is not readily recognisable, meaning that a high degree of monitoring outlay is necessary during the assembly process.

Furthermore, with the increase in the number of parts, the number increases of the dimensions in the tolerance chain of the parts to be assembled, resulting in the fact that enlarged air gaps, which can be disadvantageous, can arise on the turbine and/or compressor side of the turbocharger.

The object of the invention is now to create for a turbocharger of the previously mentioned type a frictional connection, which can be particularly highly stressed, between compressor wheel and rotor shaft.

This problem is solved according to the invention in that the torque-transferring adhered surfaces of the force-fitting connection are provided entirely or partially with a friction-increasing coating.

SUMMARY OF THE INVENTION

The invention is based on the general concept of limiting as far as the possible the number of parts to be assembled by means of undertaking special measures to increase the loading capacity of the connection on the parts that are to be connected together in a force-fitting manner. In this connection, the coating provided on work pieces is a conventional step for any number of purposes, ultimately so that only minimal outlay with conventional method steps is necessary in the manufacture of the work pieces to be connected.

The coating preferably consists of a layer, in which particles or granules are embedded, that exhibit an extremely high degree of hardness compared in comparison to the work pieces. If the work pieces are tensioned together for connecting, the particles or granules dig into the contact surfaces, which are lying one atop the other, of the work pieces to be connected, resulting in the fact that a micro form fit between the components is achieved, and namely even then when the deforming of the work pieces is effected with comparably minimal clamping force. By means of the clamping force that is as minimal as possible owing to the invention, it is ensured that under high temperatures, no plastic deformations of the components tensioned against one another arise.

If according to a constructively preferred embodiment of the invention a shaft nut untwisted on a threaded section of the rotor shaft serves to tension the compressor wheel with the rotor shaft, this can also be tightened with reduced force in such a manner that a shorter process time and correspondingly reduced costs result in the manufacture.

Moreover, a cost reduction can be achieved in that only comparably minimal demands must be placed on the solidity of the components that are tensioned together.

Furthermore, with regard to preferred features of the invention, reference is made to the claims and the following description of the drawing by means of which the one particularly preferred embodiment of the invention is described in greater detail.

Protection is claimed not only for explicitly specified or represented combinations of features, but also in principle for any combination whatsoever of the specified or represented individual features.

BRIEF DESCRIPTION OF THE DRAWING

The FIGURE illustrates a schematised view of a rotor of an exhaust-gas turbocharger.

DETAILED DESCRIPTION

In a generally known manner, a rotor 1 of an exhaust-gas turbocharger, which is not more closely shown, has a compressor wheel 2 as well as a turbine wheel 3 that is connected in a rotationally-fixed manner to the compressor wheel 2 by means of a shaft 4. The turbine wheel 3 is fused to the shaft 4 in a generally known manner, while the compressor wheel 2 is press-fittingly tensioned to the shaft 4 by means of a shaft nut 5 that is untwisted on a threaded section of a tapered part 4' of the shaft 4. In the example shown, the compressor wheel 2 is axially tensioned against a stop surface by means of the shaft nut 5 under interconnection of a bearing bush 6, which serves to bear the rotor 1, as well under interconnection of a bearing disc 7, said stop surface forming the transition between the tapered shaft part 4' and the thicker shaft part 4". In order to be able to transfer high torques between the shaft 4 and the compressor wheel 2, it is provided according to the invention that respectively one of two torque-transferring contact surfaces, which are positioned one atop the other, of components that are tensioned against one another, is provided with a friction-increasing coating 8. For example, the compressor wheel 2 and the bearing disc 7 can have a correspondingly complete or partial coating 8 in such a manner that with an already low tension force of the shaft nut 5, high torques can be transmitted between the components 5, 2, 6, 7, and 4, which axially abut one another, and correspondingly high torques between the compressor wheel 2 and the turbine wheel 3 can be transmitted.

In theory, it is sufficient to coat respectively one of two contact surfaces, which are resting one atop the other, in such a manner that the coating 8 needs be applied to minimal components only.

The coating 8 consists respectively of a carrier material and particles or granules embedded therein, which particles or granules exhibit, in addition to a high degree of thermal loading capacity, a very high degree of solidity, that is to say the hardness of these particles or granules is greater than the hardness of the contact surfaces tensioned against one another. It is thereby ensured that the particles or granules dig themselves into the contact surfaces, which are tensioned against one another, of the components and furthermore effect a micro form fit between the components that are tensioned against one another.

The above-describing force-fitting fixing of the compressor wheel 2 on the shaft 4 can also be provided for the turbine wheel 3 in such a manner that complicated welding processes for connecting the shaft 4 and the turbine wheel 3 can be dispensed with.

The invention claimed is:

1. A method for assembling a turbocharger, comprising:

coating at least a portion of at least one of a compressor wheel, a turbine wheel and a shaft, wherein the coating includes a carrier layer and a particle embedded in the carrier layer;

connecting at least one of the turbine wheel and the compressor wheel with the shaft in a rotationally-fixed manner;

attaching a shaft nut to a threaded section of the shaft;

clamping the compressor wheel against a bearing element having an opening receiving the shaft, and the bearing element in turn is clamped against a stop surface of the shaft, wherein clamping the compressor wheel against the bearing element includes applying an axial force to the compressor wheel defined by the shaft nut untwisted against the compressor wheel on the threaded section of the shaft; and forming a micro-fit between the coated portion of the at least one of the compressor wheel, turbine wheel and shaft with a contact surface of at least one other of the compressor wheel, turbine wheel and shaft, the coating providing a friction-increasing connection between the coated portion and the contact surface and exhibiting via the particle a greater hardness with a greater thermal loading capacity in comparison to the respective contact surface.

2. The method claim 1, wherein the compressor wheel is coated on a surface tensioned clamped against the bearing element.

3. A rotor assembly of a turbocharger, comprising:

a shaft having a thinner shaft part, a thicker shaft part and a stop surface that forms a transition between the thinner shaft part and the thicker shaft part, and the thinner shaft part has a threaded section;

a shaft nut coupled to the threaded section of the thinner shaft part;

a bearing element having an opening receiving the shaft;

a compressor wheel force-fittingly clamped to the shaft, the shaft nut providing an axial force against the compressor wheel that is defined by the shaft nut untwisted against the compressor wheel on the threaded section of the thinner shaft part, such that the shaft nut, the compressor wheel and the bearing element are axially clamped against one another via the axial force with the compressor wheel being axially clamped against the bearing element that is in turn axially clamped against the stop surface of the shaft;

a turbine wheel connected in a rotationally fixed manner to the compressor wheel by the shaft;

wherein the compressor wheel and the bearing element have a torque-transferring contact surface positioned adjacent one another, and wherein the thinner shaft part and the compressor wheel have a contact surface adjacent one another; and a friction-increasing coating disposed on at least one of (i) the contact surface of at least one of the thinner shaft part and the compressor wheel and (ii) the torque-transferring contact surface of at least one of the compressor wheel and the bearing element;

wherein the coating includes a carrier layer and a particle embedded in the carrier layer; and wherein the coating provides a friction-increasing connection and the particle of the coating has a greater hardness and a greater thermal loading capacity in comparison to the at least one of the contact surface and the torque-transferring contact surface having the coating disposed thereon.

4. The rotor assembly of claim 3, wherein two torque-transferring contact surfaces are formed, each between the compressor wheel and the bearing element and between the shaft nut and the compressor wheel, and wherein the coating is disposed on one torque-transferring contact surface between the compressor wheel and the bearing element and between the shaft nut and the compressor wheel.

5. The rotor assembly of claim 3, wherein the bearing element includes a bearing disc and a bearing bush surrounding the thinner shaft part.

6. The rotor assembly of claim 5, wherein the bearing disc abuts the thicker shaft part at the stop surface.

7. A turbocharger comprising:

a shaft including a thinner shaft part, a thicker shaft part and a stop surface that forms a transition between the thinner shaft part and the thicker shaft part, the thinner shaft part having a threaded section;

a shaft nut attached to the threaded section of the thinner shaft part;

a bearing element having an opening receiving the shaft; and a rotor having a turbine wheel and a compressor wheel, and the compressor wheel is force-fittingly clamped to the shaft, wherein the shaft nut is attached to the thinner shaft part and untwisted against the compressor wheel on the threaded section, such that the compressor wheel is axially clamped against the bearing element that is in turn axially clamped against the stop surface of the shaft;

wherein the turbine wheel is connected in a rotationally fixed manner to the compressor wheel by said shaft;

whereby a first pair of torque-transmitting contact surfaces positioned one atop the other is formed by the stop surface and an abutting side of the bearing element, and a second pair of the torque-transmitting contact surfaces is formed by an opposing side of the bearing element and an abutting surface of the compressor wheel;

wherein one contact surface of each of the first pair of torque-transmitting contact surfaces and the second pair of torque-transmitting contact surfaces is provided with a friction-increasing coating that includes a particle embedded in a carrier layer, and wherein the particle has a greater hardness with a greater thermal loading capacity in comparison to the contact surface.

8. The turbocharger as specified in claim 7, wherein the particle contained in the coating is at least one of pressed and sunk into the contact surfaces facing one another of the first pair of torque-transmitting contact surfaces and the second pair of torque-transmitting contact surfaces.

9. The turbocharger as specified in claim 8, wherein the turbine wheel is force-fittingly clamped to the shaft.

10. The turbocharger as specified in claim 7, wherein the turbine wheel is force-fittingly clamped to the shaft.

11. The turbocharger as specified in claim 7, wherein the coating is further disposed on one of the shaft and the compressor wheel and further wherein the coating reduces a clamping force required to force-fit the compressor wheel with the shaft.

12. The turbocharger as specified in claim 7, wherein a third pair of the torque-transmitting contact surfaces is formed by an opposing surface of the compressor wheel and an abutting surface of the shaft nut.

13. The turbocharger as specified in claim 7, wherein the shaft nut provides an axial force clamping the compressor wheel against the shaft, the axial force defined by the shaft nut which is untwisted against the compressor wheel on the threaded section of the thinner shaft part.

* * * * *